US011246438B2

(12) United States Patent
Pavlou

(10) Patent No.: US 11,246,438 B2
(45) Date of Patent: Feb. 15, 2022

(54) DEVICE FOR REDUCING THE INFLUENCE OF MOTION ON A DRINKING VESSEL

(71) Applicant: Stephanos Andrea Pavlou, London (GB)

(72) Inventor: Stephanos Andrea Pavlou, London (GB)

( * ) Notice: Subject to any disclaimer, the term of this patent is extended or adjusted under 35 U.S.C. 154(b) by 191 days.

(21) Appl. No.: 16/611,892

(22) PCT Filed: May 25, 2018

(86) PCT No.: PCT/GB2018/051433
§ 371 (c)(1),
(2) Date: Nov. 8, 2019

(87) PCT Pub. No.: WO2018/215792
PCT Pub. Date: Nov. 29, 2018

(65) Prior Publication Data

US 2021/0076856 A1 Mar. 18, 2021

(30) Foreign Application Priority Data

May 26, 2017 (GB) ..... 1708470

(51) Int. Cl.
*A47G 23/02* (2006.01)
*A47G 23/03* (2006.01)

(52) U.S. Cl.
CPC ..... *A47G 23/0225* (2013.01); *A47G 23/0208* (2013.01); *A47G 23/03* (2013.01);
(Continued)

(58) Field of Classification Search
CPC ..... A47G 23/0225; A47G 23/0208; A47G 23/03; A47G 2023/0291; A47G 2200/22; Y10S 248/91; Y10S 248/912
See application file for complete search history.

(56) References Cited

U.S. PATENT DOCUMENTS 560,447 A * 5/1896 Voege ..... A47B 96/1425 211/107
5,769,264 A * 6/1998 Lipkowitz ..... A47G 23/0625 220/575

(Continued)

FOREIGN PATENT DOCUMENTS

FR 2729553 A1 7/1996
WO 2017044955 A1 3/2017

OTHER PUBLICATIONS

Fraser, Cassandra, "Search Report under Section 17(5) for GB Application No. GB1708470.8," United Kingdom Intellectual Property Office, dated Nov. 23, 2017.

(Continued)

*Primary Examiner* — Anita M King
(74) *Attorney, Agent, or Firm* — Florek & Endres PLLC

(57) ABSTRACT

A device is provided for reducing the influence, on a drinking vessel (240), of linear and/or rotational motions of a surface on which the drinking vessel is placed, for example for use on a marine vessel. The device comprises a pliable structure and is provided with a plurality of slits (120) arranged between a plurality of cooperating portions (102) to accommodate a plurality of drinking vessels, in particular drinking vessels having a base and a stem, such as wine glasses. The cooperating portions are adapted to accept a drinking vessel, and are operable to at least partially envelop the drinking vessel by conforming to at least a part of the upper surface of the base of the drinking vessel.

20 Claims, 6 Drawing Sheets

(52) U.S. Cl.
CPC .. *A47G 2023/0291* (2013.01); *A47G 2200/22* (2013.01); *Y10S 248/91* (2013.01); *Y10S 248/912* (2013.01)

(56) References Cited

U.S. PATENT DOCUMENTS

| | | | | |
|---|---|---|---|---|
| 7,641,156 | B2 * | 1/2010 | Medders | A47G 25/12 248/125.8 |
| 9,220,337 | B1 * | 12/2015 | Wenzel | A47B 13/023 |
| 9,534,708 | B2 * | 1/2017 | Cripps, II | F16L 3/22 |
| 9,549,627 | B1 * | 1/2017 | Grady | A47G 23/0208 |
| 2006/0231698 | A1 | 10/2006 | Richardson | |
| 2007/0131834 | A1 | 6/2007 | Reid | |
| 2013/0119005 | A1 * | 5/2013 | Gray | A47F 7/0064 211/85.18 |
| 2014/0312195 | A1 | 10/2014 | Krzyzaniak et al. | |
| 2014/0339115 | A1 * | 11/2014 | Chiorazzi | A47G 23/0641 206/426 |

OTHER PUBLICATIONS

Szekely, Zsolt "International Search Report and Written Opinion of the International Searching Authority for International Application No. PCT/GB2018/051433," European Patent Office, dated Sep. 17, 2018.

* cited by examiner

DEVICE FOR REDUCING THE INFLUENCE OF MOTION ON A DRINKING VESSEL

TECHNICAL FIELD OF THE INVENTION

The present invention relates a device for restraining stemmed glasses upon unstable surfaces, more particularly but not exclusively, to a device to reduce/prevent the slide and/or topple of a wine glass placed upon a surface of a craft undergoing motion, such as a watercraft.

BACKGROUND TO THE INVENTION

A craft is defined as a vehicle or marine vessel used for transportation on water, land, or in air or space. A craft's motion is defined by six degrees of freedom. These degrees of freedom may be broken down into linear motions and rotational motions. The linear motions of up/down, side-to-side and front/back are often named: heave, sway and surge respectively when applied to the movements of a watercraft. Similarly, rotation about the longitudinal, lateral and vertical axis of a watercraft is often named: pitch, roll and yaw. As the craft undergoes these motions, particularly pitch, roll and surge, objects within the craft experience resultant forces as the surface on which they are placed moves.

It is often desirable to consume a beverage on a craft such as a watercraft. The choice of beverage consumed is personal to the consumer, however wine is a popular choice. Traditionally wine is drunk from a stemmed wine glass. This is advantageous as heat exchange between the consumer and the wine is reduced, thus the wine maintains an optimum temperature for a prolonged period of time. While advantageous for consumption, the stemmed wine glass is inherently less stable than its non-stemmed counter parts. Therefore, the movements of a craft are more likely to result in the slide or topple of a stemmed wine glass than its non-stemmed counterparts.

It is an object of the present invention to provide a device that reduces the influence of the linear and rotational motions of a craft on the drinking vessel particularly a stemmed wine glass, thus reducing the probability that said drinking vessel will topple or slide.

SUMMARY OF THE INVENTION

According to a first aspect of the present invention, there is provided a device for reducing the influence, on a drinking vessel, of linear and/or rotational motions of a surface on which the drinking vessel is placed, characterised in that the device is provided with a plurality of cooperating portions adapted to accept a drinking vessel, the cooperating portions operable to at least partially envelop the drinking vessel by conforming to at least a part of the structure of the drinking vessel.

By enveloping a part of the drinking vessel, the device effectively increases the interaction between the drinking vessel and the surface on which the drinking vessel is placed, typically by extending the effective area of the base of the drinking vessel and lowering the centre of gravity of the combined 'device—drinking vessel system' when compared to a standalone drinking vessel. This is advantageous as a system with a lower centre of gravity is less liable to topple.

The cooperating portions may be operable to envelop and conform to the base of a drinking vessel, in particular they may be operable to envelop and conform to the stem of the glass, and/or to envelop and conform to the upper surface of the base of a stemmed glass.

There may be a slit formed between cooperating portions.

The device may comprise a plurality of slits between cooperating portions to accommodate a plurality of drinking vessels. The slits may divide the device into segments. Each segment may comprise two segment portions, each segment portion cooperating with an adjacent portion of another segment. Each cooperating portion may be adjacent to a slit. The cooperating portions of respective segments may be arranged in mutually adjacent pairs, on either side of a respective slit. There may be no gap between adjacent pairs of cooperating portions. Adjacent cooperating portions may overlap.

Each slit may extend inward from the perimeter of the device. Each slit may extend towards the centre of the device. Each slit may be of comparable width to the diameter of a typical wine glass stem or slightly narrower; for example the width of each slit may be less than 2 cm, 1 cm or 0.5 cm. The inward end of the slit may terminate in a bulbous node. The bulbous node may be of comparable diameter to the stem of a typical wine glass; for example the diameter of the bulbous node may be at least 0.5 cm, 1 cm, 2 cm, 3 cm or 4 cm.

The device may have a length and/or width greater than 5 cm and less than 60 cm. The device may have a length and/or width greater than 10 cm and less than 55 cm. The device may have a length and/or width greater than 15 cm and less than 50 cm. The device may have a length and/or width greater than 20 cm and less than 45 cm. The device may have a length and/or width greater than 25 cm and less than 40 cm.

The device may have a thickness greater than 1 cm and/or less than 10 cm. The device may have a thickness greater than 1.5 cm and/or less than 6 cm. The device may have a thickness greater than 2 cm and/or less than 5 cm. The device may have a thickness greater than 2.5 cm and/or less than 4 cm.

The device may weigh more than 100 g and/or less than 10 kg. The device may weigh more than 500 g and/or less than 5 kg. The device may weigh more than 2 kg and/or less than 4 kg, for example 3.5 kg.

The device may comprise a generally shallow toroidal shape. The device may comprise a generally shallow cylindrical shape. The device perimeter may be generally circular. The device perimeter may of course be another polygonal shape, for example a shape of 3, 4, 5, 6, 7, 8, 9 or 10 sides, or a novelty shape, such as an anchor.

The device may be provided with a generally circular hole, which may be central. The diameter of the hole may be greater than 5 cm and/or less than 11 cm. The diameter of the hole may be greater than 6 cm and/or less than 10 cm. The diameter of the hole may be greater than 7 cm and/or less than 9 cm, for example 8 cm.

The device may comprise a pliable structure. The pliable structure may deform to accept a drinking vessel and may be resilient. The pliable structure may comprise a homogenous material. The homogenous material may be silicone.

The pliable structure may comprise multiple component materials. The pliable structure may comprise an internal structure within an external housing.

The internal structure may be malleable. The internal structure may comprise a fluid or gel. Alternatively, the internal structure may comprise a granular material. For example, the internal structure may comprise gravel (e.g.

aquarium gravel), sand, pellets, ball bearings or the like. The internal structure may comprise memory foam.

The external housing may be flexible. The external housing may comprise a textile such as fabric, plastic, leather or metal mesh, for example The device may comprise a non-slip surface. A section of the exterior housing of the device may comprise a non-slip surface. An underside of the device may comprise a non-slip surface. A section of the underside of the device may comprise a non-slip surface.

According to a second aspect of the invention, there is provided a method of for reducing the influence, on a drinking vessel, of linear and/or rotational motions of a surface on which the drinking vessel is placed, the method comprising providing a device according to the first aspect of the invention, optionally including any optional features, and manipulating a plurality of cooperating portions so as to accept a drinking vessel, such that the cooperating portions at least partially envelop the drinking vessel by conforming to at least a part of the structure of the drinking vessel.

The device may comprise one or more slits and the method may comprise introducing a stemmed drinking vessel into a slit, such that co-operating portions of the device either side of the slit accept and envelop the base of the stemmed drinking vessel.

DETAILED DESCRIPTION OF THE INVENTION

In order that the invention may be more clearly understood one or more embodiments thereof will now be described, by way of example only, with reference to the accompanying drawings, of which:

Figure 1:
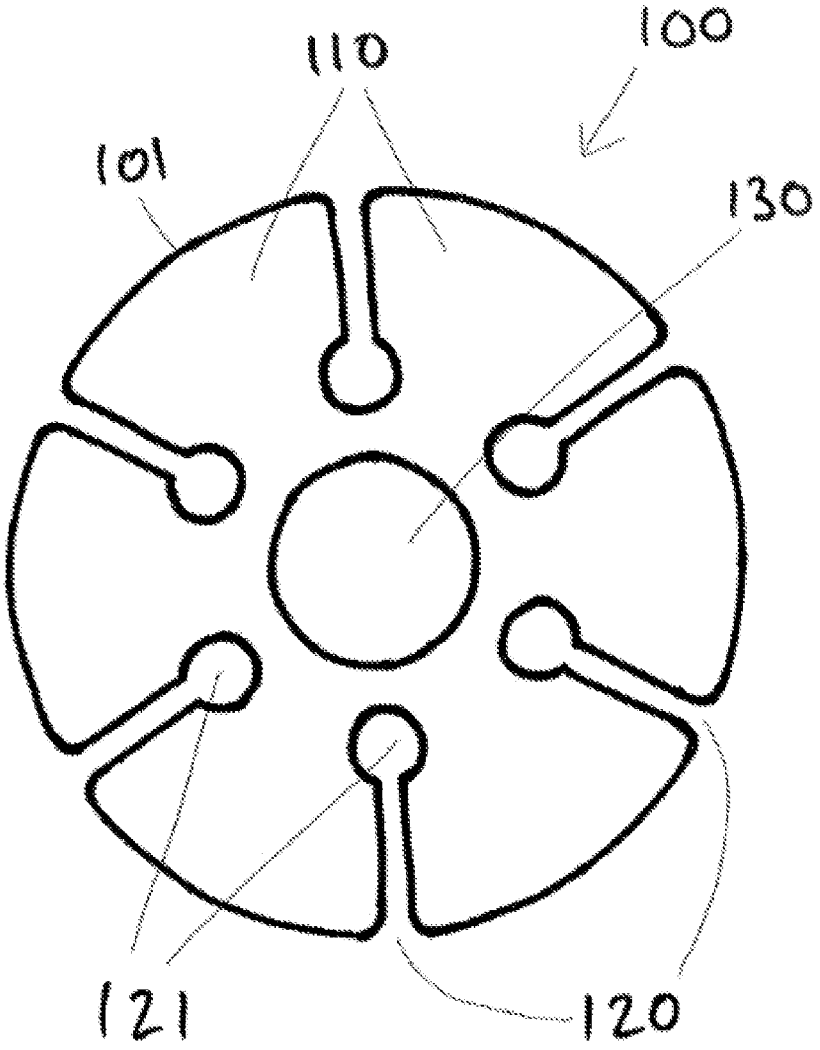
FIG. 1 is a top-down view of a device for restraining a drinking vessel according to a first embodiment of the invention.

FIG. 1 shows a top down view of a first embodiment of a device 100 for restraining a drinking vessel so as to reduce the influence of linear and/or rotational motions of a surface on which the drinking vessel is placed. The device 100 is a shallow toroid with a depth of around 3 cm and a diameter of around 40 cm. The device perimeter 101 is provided with 6 slits 120. The slits 120 divide the perimeter of the device into 6 equal segments 110. Each slit 120 is approximately 1 cm wide, extends approximately 10 cm radially inwards from the device perimeter 101 towards the centre of the device 100 and passes through the entire depth of the device 100. Each slit 120 terminates with a bulbous node 121 of diameter 2 cm. The device 100 is provided with a circular central hole 130 of approximately 8 cm diameter corresponding to the typical diameter of a wine bottle.

Figure 2:
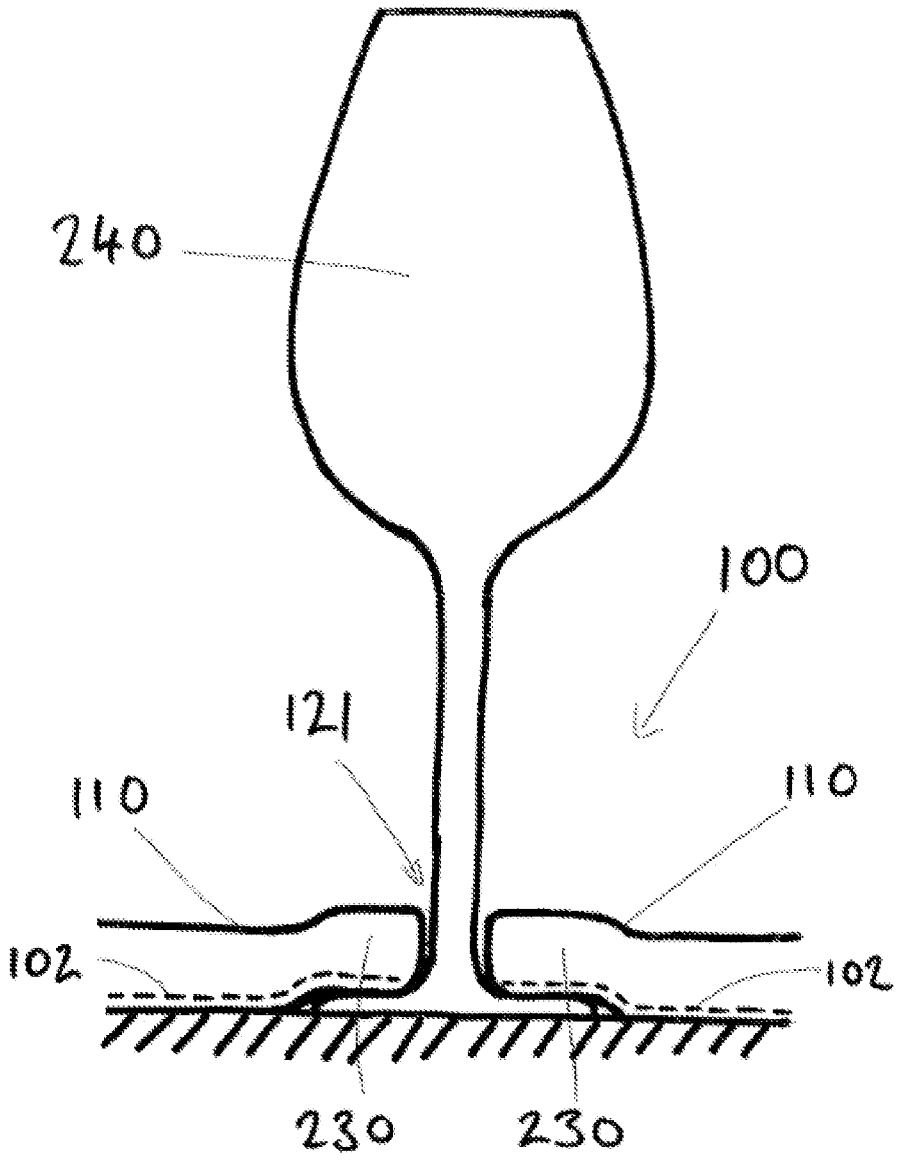
FIG. 2 is a cross-sectional view of the device according to FIG. 1.
Figure 3:
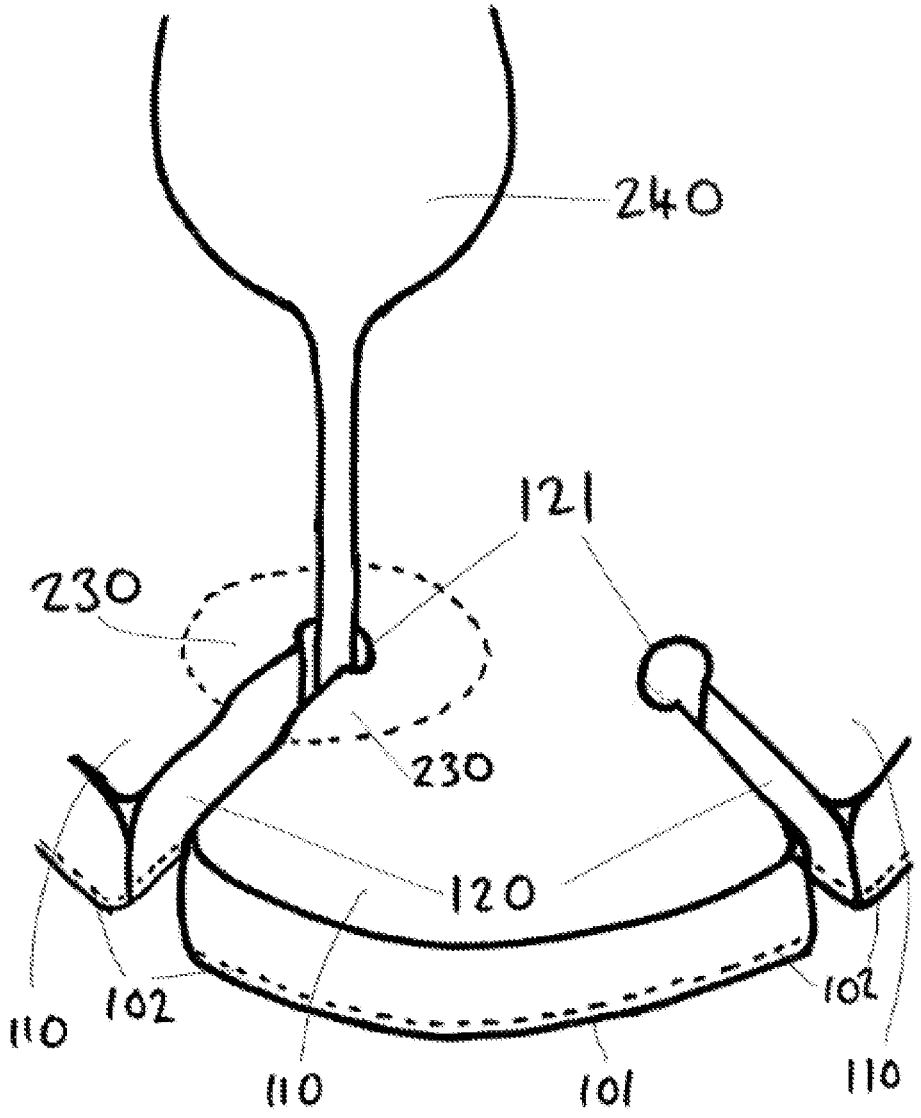
FIG. 3 is a perspective view of part of the device according to FIGS. 1 and 2.

With reference to FIGS. 2 and 3, a stemmed glass 240 is shown present within a node 121. Cooperating portions 230 of the segments 110 are shown to be substantially overlapping the base of the stemmed glass 240. The underside of the device 100 comprises a non-slip surface 102. The base non-slip surface 102 contacts both the glass and the surface on which the glass 240 and device 100 are placed.

Figure 6:
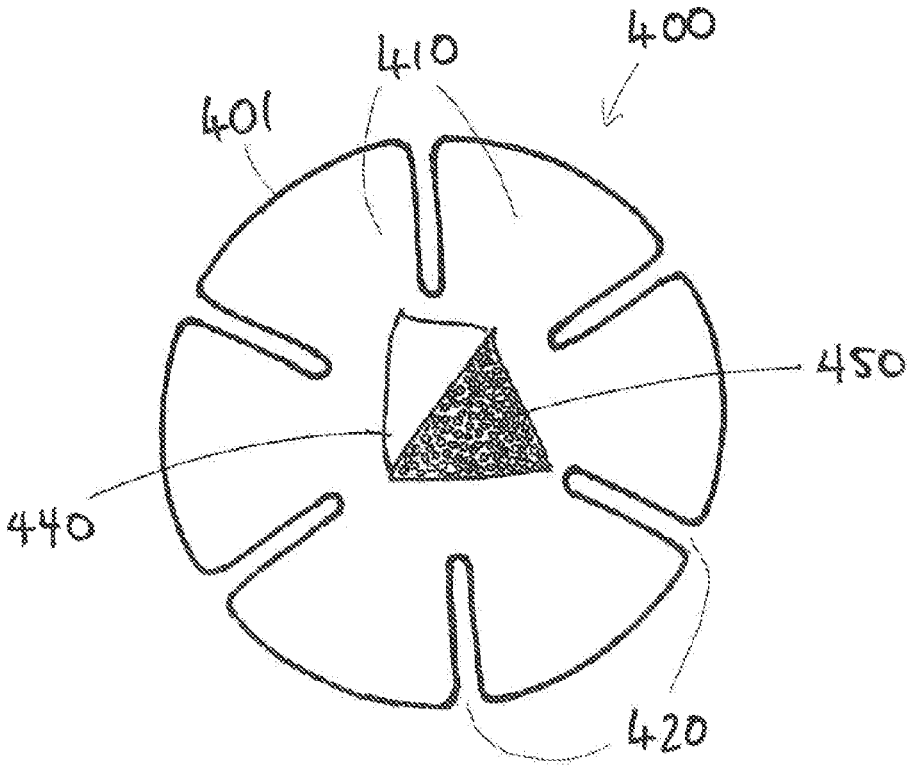
FIG. 6 is a plan view of an embodiment of the invention with an external housing and a malleable internal structure, where the external housing is cut and peeled back in a portion to show the internal structure.

The device comprises an external housing 440 and a malleable internal structure 450, as shown in FIG. 6. The external housing 440 comprises an upper flexible fabric exterior and the non-slip surface 102. The non-slip surface is stitched to the upper body of the device. Within the external housing of the device is a malleable internal structure 450 comprising aquarium gravel. The gravel is chosen such that it does not react with liquids which may come into contact with the device (such as water, wine, cocktails, cleaning products etc.) and that it is heavy. The device weighs approximately 3.5 kg.

When in use, the device 100 increases the stability of stemmed glasses 240 by providing a counterweight to the base of the glass 240. In order to use the device, the device 100 is first placed onto a desired surface (such as a table) with the non-slip underside contacting the desired surface. A segment 110 is peeled towards the centre of the device 100 by the user, allowing access to a bulbous node 121 via a temporarily widened slit 120 between two segments 110. A stemmed glass 240 is then introduced to the bulbous node 121 via this widened slit 120 between cooperating portions 230 of adjacent segments. The user then replaces the segment 110, now upon the base of the stemmed glass 240 and the pair of mutually adjacent cooperating portions 230 of the adjacent segments 110 enclose the base of the stemmed glass 240. The device's structure envelops the stem of the glass and envelops and conforms to the shape of the base of the stemmed glass 240 thus providing a secure hold upon the glass 240. Additional glasses 240 can be introduced to the device in the same manner. A wine bottle may be introduced to the device 100 by simply placing it within the central hole 130.

The weight of the device presses down upon the stemmed glass 240 effectively lowering the centre of gravity of the stemmed glass 240. Via this method, the stemmed glass 240 can experience larger linear and rotational forces (e.g. as experienced onboard a boat) before experiencing a slide or topple.

The non-slip surface 102 provides increased frictional forces between the glass 240 and device 100, and surface and device 100. This reduces the tendency of the glass to slide upon the surface.

Figure 4:
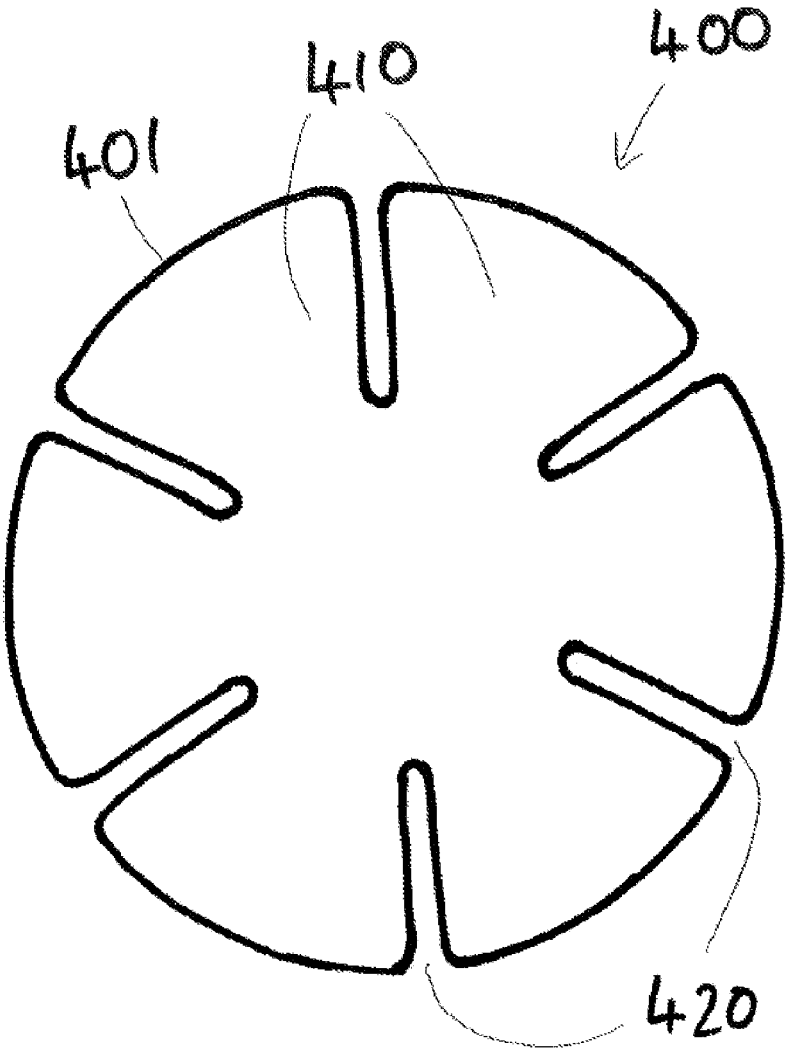
FIG. 4 is a top-down view of a device for restraining a drinking vessel according to a second embodiment of the invention.

In FIG. 4, a second embodiment of a device 400 for restraining a drinking vessel 240 is shown. The device 420 is a shallow cylinder with a depth of around 3 cm and a diameter of around 40 cm. The device perimeter 401 is provided with 6 slits 420. The slits 420 divide the perimeter of the device into 6 equal segments 410. Each slit 420 is approximately 1 cm wide, extends approximately 10 cm radially inwards from the device perimeter 401 towards the centre of the device 400 and passes through the entire depth of the device 400.

Figure 5:
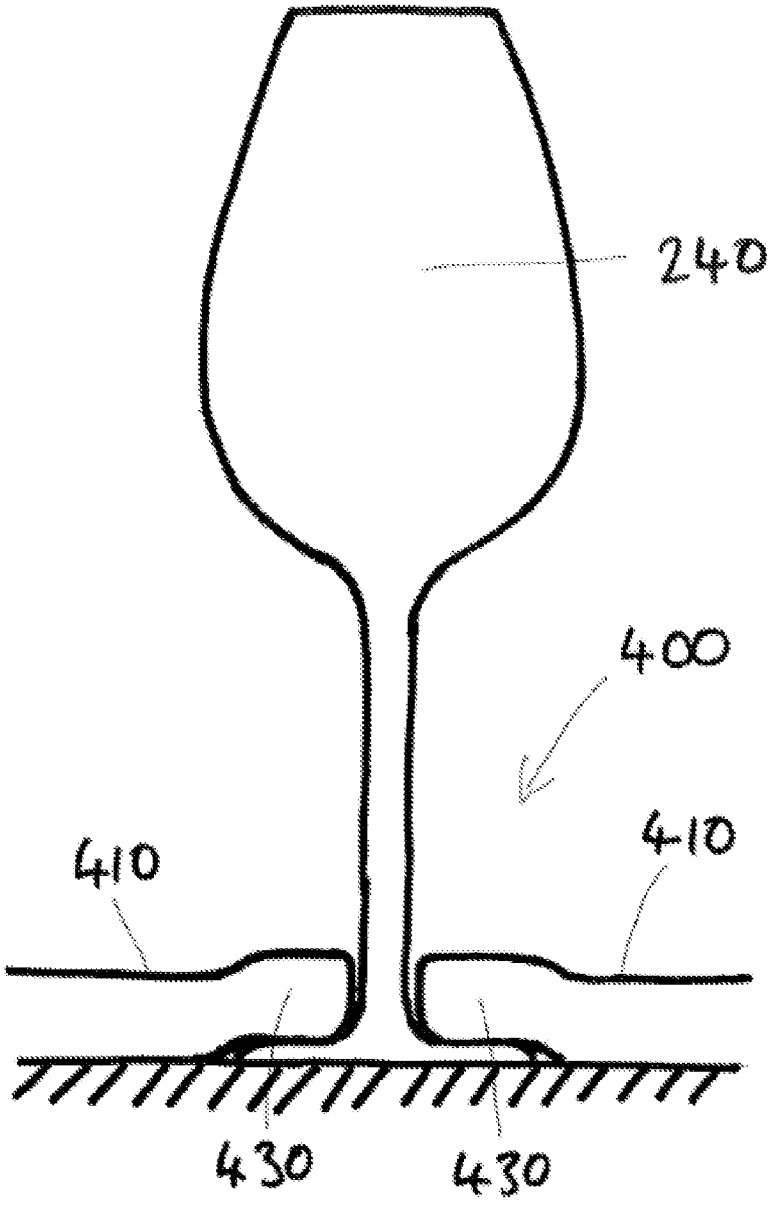
FIG. 5 is a cross-sectional view of the device according to FIG. 4.

With reference to the device 400 cross-section, shown in FIG. 5, the device 400 comprises a singular homogenous material—silicone. The silicone material used for the device 400 is inherently non-slip and deforms to the base of the stemmed glass 240.

The mode of operation is the same as the first embodiment, with pairs of cooperating portions 430 of the segments 410 substantially overlapping the base of the stemmed glass 240 so as to reduce the influence on the glass 240 of linear and/or rotational motions of a surface on which the glass 240 is placed.

The above embodiments are described by way of example only. Many variations are possible without departing from the scope of the invention as defined in the appended claims.

The invention claimed is:

1. A device for reducing the influence, on a drinking vessel, of linear and/or rotational motions of a surface on which the drinking vessel is placed, wherein the device comprises a pliable structure and is provided with a plurality of slits arranged between a plurality of cooperating portions to accommodate a plurality of drinking vessels having a base and a stem, the cooperating portions adapted to accept a drinking vessel, the cooperating portions operable to at least partially envelop the drinking vessel by conforming to at least a part of the upper surface of the base of the drinking vessel.

2. The device as claimed in claim 1, wherein the slits divide the device into segments.

3. The device as claimed in claim 2, wherein each segment comprises two segment portions.

4. The device as claimed in claim 3, wherein each segment portion cooperates with an adjacent portion of another segment.

5. The device as claimed in claim 1, wherein the cooperating portions are arranged in mutually adjacent pairs, on either side of a respective slit.

6. The device as claimed in claim 1 wherein each slit extends inward from the perimeter of the device.

7. The device as claimed in claim 6 wherein the inward end of the slit terminates in a bulbous node.

8. The device as claimed in claim 7, wherein the diameter of the bulbous node is at least 2 cm.

9. The device as claimed in claim 6, wherein the underside of the device comprises a non-slip surface.

10. The device as claimed in claim 1, wherein the device has a length and/or width greater than 20 cm and less than 45 cm.

11. The device as claimed in claim 1, wherein the device has a generally shallow toroidal shape.

12. The device as claimed in claim 1, wherein the device has a generally shallow cylindrical shape.

13. The device as claimed in claim 1, wherein the pliable structure comprises a homogenous material.

14. The device as claimed in claim 1, wherein the pliable structure comprises multiple component materials.

15. The device as claimed in claim 1, wherein the pliable structure comprises an internal structure within an external housing.

16. The device as claimed in claim 15, wherein the internal structure is malleable.

17. The device as claimed in claim 16, wherein the internal structure comprises a granular material.

18. The device as claimed in claim 15, wherein the external housing is flexible.

19. The device according to claim 1 which weighs at least 500 g.

20. A device for reducing the influence, on a drinking vessel, of linear and/or rotational motions of a surface on which the drinking vessel is placed, wherein the device comprises a granular internal structure within a flexible external housing; has an underside comprising a non-slip surface and is provided with a plurality of slits extending inwards from its perimeter and arranged between a plurality of cooperating portions to accommodate a plurality of drinking vessels having a base and a stem, the cooperating portions adapted to accept a drinking vessel, the cooperating portions operable to at least partially envelop the drinking vessel by conforming to at least a part of the upper surface of the base of the drinking vessel.

* * * * *